US012687159B1

(12) United States Patent
Feng

(10) Patent No.: US 12,687,159 B1
(45) **Date of Patent: *Jul. 21, 2026**

(54) COMPRESSION OF INDIFFERENT GASES WITH VAPOR CONTROL

(71) Applicant: Zhili Feng, Knoxville, TN (US)

(72) Inventor: Zhili Feng, Knoxville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/344,275

(22) Filed: Sep. 29, 2025

Related U.S. Application Data

(62) Division of application No. 19/176,828, filed on Apr. 11, 2025, now Pat. No. 12,584,471.

(60) Provisional application No. 63/765,613, filed on Mar. 1, 2025.

(51) Int. Cl.
*F04B 39/00* (2006.01)

(52) U.S. Cl.
CPC ..... *F04B 39/0011* (2013.01)

(58) Field of Classification Search
CPC ..... F04B 39/0011
USPC ..... 417/92, 103
See application file for complete search history.

(56) References Cited

U.S. PATENT DOCUMENTS 2,502,074 A * 3/1950 Brown ..... F04B 39/0011 417/101
5,073,090 A * 12/1991 Cassidy ..... F04B 39/0011 417/103
9,162,410 B2 * 10/2015 Adler ..... F04F 1/10

OTHER PUBLICATIONS

Van De Ven and Li "Liquid piston gas compression", Applied Energy, v86 (2009), 2183-2191.
Sdanghia et al, "Review of the current technologies and performances of hydrogen compression for stationary and automotive applications," Renewable and Sustainable Energy Reviews 102 (2019) 150-170.
Kermani et al, "Evaluation of ionic liquids as replacements for the solid piston in conventional hydrogen reciprocating compressors: A review" Int J. Hydrogen Energy 45 (2020) 16337-16354.

* cited by examiner

*Primary Examiner* — Bryan M Lettman

(57) ABSTRACT

A method and apparatus for compressing gaseous hydrogen or other gases utilize a liquid compressor to achieve high pressure while controlling vapor content. Gaseous hydrogen from a source at an inlet pressure is compressed in a liquid compression chamber using a liquid, preferably water or a water-based liquid, to a predetermined pressure at which vapor in the compressed gas is below the required concentration level for applications. The compressed gas flows into a high-pressure gas chamber, where it is isolated from the compression liquid once the predetermined pressure is reached, ensuring the vapor content remains below a specified threshold. The compressed gas is then transferred to a storage tank at a lower storage pressure. Embodiments include cooling the high-pressure chamber, adding freezing-point-lowering additives to the liquid. The invention enhances compression efficiency, reduces costs, and meets stringent purity requirements for applications such as fuel cells.

3 Claims, 5 Drawing Sheets

COMPRESSION OF INDIFFERENT GASES WITH VAPOR CONTROL

REFERENCE TO RELATED APPLICATIONS

This application is a divisional of U.S. Non-Provisional patent application Ser. No. 19/176,828, filed on Apr. 11, 2025, which claims the benefit of U.S. Provisional Patent Application No. 63/765,613, filed on Mar. 1, 2025, both by the present inventor, the disclosures of which are hereby incorporated by reference in its entirety.

FIELD OF THE INVENTION

This invention relates to compressors and methods for compressing hydrogen and other gases to high pressures. More specifically, it pertains to a method and apparatus utilizing water-based liquid to compress hydrogen or other gases to elevated pressures while ensuring the water vapor content in the compressed gas at or below a predetermined threshold.

REFERENCE TO RELATED PATENTS 9,162,410B October 2015 Adler et al B30B9/00
5,073,090 February 1990 Cassidy 417/102

BACKGROUND OF THE INVENTION

Hydrogen serves as a versatile energy carrier, producible from diverse sources, including renewable and sustainable ones, and convertible into various energy forms such as thermal, electrical, and mechanical energy. Recognized as a promising environmentally friendly solution, hydrogen is anticipated to play a significant role in the energy transition over the coming decades. Although it possesses the highest gravimetric energy density among non-nuclear fuels, gaseous hydrogen exhibits the lowest volumetric energy density compared to commonly used fuels. Consequently, increasing its volumetric energy density is critical to enabling its widespread adoption. Among available methods, compressing gaseous hydrogen to high pressure remains the predominant approach for storage and delivery, particularly for durations spanning days, weeks, or longer. Additionally, industrial processes such as the Haber-Bosch process for ammonia synthesis and hydrocracking depend on high-pressure hydrogen.

Mechanical compressors are the most widely employed devices for hydrogen compression. These include reciprocating piston compressors, diaphragm compressors, hydraulically driven piston compressors, and linear compressors. Capable of compressing hydrogen from pressures of 1-30 bars to 200-1000 bars or higher, these systems typically require multiple stages to achieve elevated pressure levels.

Certain hydrogen applications, notably Proton Exchange Membrane (PEM) fuel cells, demand exceptionally high gas purity. Standards such as SAE J2719 ("Hydrogen Fuel Quality for Fuel Cell Vehicles") and ISO 14687 ("Hydrogen Quality Requirements-Product Specification") specify stringent purity requirements. Even trace contamination from gases or lubricants can impair fuel cell performance, necessitating oil-free compressors and meticulous material selection.

Compared to other gases like nitrogen or air, hydrogen poses unique challenges for oil-free mechanical compression due to its small molecular size, which increases its propensity to leak through seals and valves. This necessitates specialized sealing materials and robust containment systems to mitigate safety risks from leaks or malfunctions. Ideally, hydrogen compression should occur isothermally to minimize energy consumption, but its high compressibility and low molar mass render this difficult to achieve. Heat generated during mechanical compression is often dissipated as waste, reducing efficiency-typically averaging 45% for reciprocating piston and diaphragm compressors- and potentially damaging components. Moreover, the high cost of hydrogen compressors stems from specialized materials, complex engineering, and the need to withstand high pressures. With numerous moving parts under significant operational stress, these compressors are costly to manufacture and maintain. Maintenance, particularly of valves, packing, and piston rings to prevent leaks, accounts for approximately 90% of operating and maintenance (O & M) costs, often requiring extended downtime and further elevating expenses. This cost barrier is a major obstacle to the widespread adoption of hydrogen technologies.

Beyond mechanical compressors, alternative hydrogen compression technologies exist but are less prevalent due to limitations in engineering, flow rates, or cost. Liquid piston compressors, for instance, are positive displacement devices that utilize a liquid column—moved by a pump—to directly compress gas within a confined space, eliminating the need for mechanical sliding seals. Unlike solid pistons, liquid pistons require no clearance for thermal expansion, enabling full compression of the gas volume.

Liquid piston compressors have been applied in compressed air energy storage, typically using water due to its availability, near-incompressibility, and superior heat transfer properties, which enhance efficiency through reversible thermal energy storage. However, when compressing hydrogen with water, a significant drawback emerges: excessive water vapor in the compressed hydrogen. For example, at 20° C. and 400 bars (5800 psi), the saturation water vapor content in hydrogen is approximately 55 μmol/mol—over ten times the 5 μmol/mol maximum specified by SAE J2719 and ISO 14687 for PEM fuel cells. Even at 700 bars (10,150 psi) and 20° C., the saturation vapor content remains at 33.5 μmol/mol, still exceeding these limits.

One proposed solution to mitigate water vapor and impurity issues in hydrogen compression involves using ionic liquids as the compression medium in liquid piston compressors. Ionic liquids, low-melting-point organic salts composed of organic cations and organic or inorganic anions, exhibit negligible vapor pressure and low hydrogen solubility—key attributes for this application. Imidazolium-based ionic liquids, specifically formulated for high-pressure hydrogen compression, aim to minimize wear, enhance efficiency, and prevent contamination.

Despite their promise, ionic liquid compressors face notable drawbacks. First, their production cost significantly exceeds that of water or conventional lubricants, and compatibility with specialized materials further increases system expenses. Second, ionic liquids are susceptible to water absorption, even in hydrophobic formulations, altering their physical and chemical properties and potentially causing corrosion, thermal instability, or degradation. Hydrogen, particularly from electrolysis (which contains several percent water by volume), often has water vapor that must be thoroughly removed prior to compression with ionic liquids—a complex and costly process that undermines economic viability.

Thus, a persistent need exists for an improved hydrogen compression system and method that enhances efficiency, simplifies operation, and reduces capital and operational costs for storage and distribution. This need extends to other gaseous media requiring controlled water content for operational and end-use requirements. The present invention addresses these deficiencies and overcomes the limitations of prior art compressors, as elucidated in the following description.

SUMMARY OF THE INVENTION

The present invention pertains to a method and apparatus for compressing gaseous hydrogen and other gases that exhibits minimal chemical reactivity with its environment under standard conditions and negligible physiological effects upon inhalation. Examples of such gases, also known as indifferent gases, include hydrogen, nitrogen, argon, helium, and air.

In one embodiment of the invention, gaseous hydrogen or another indifferent gas, supplied at an inlet pressure P1, is compressed inside a liquid compression chamber using a liquid, preferably water or a water-based liquid. The liquid compression chamber is fluidly connected to a high-pressure gas chamber. During compression, only the compressed gas flows from the liquid compression chamber into the high-pressure gas chamber thereby separating the compressed gas from the compression liquid. Furthermore, the pressures in both chambers substantially equalize and rise concurrently, reaching a predetermined compression pressure P2 in the high-pressure gas chamber. The predetermined compression pressure P2 is selected to ensure that the water vapor content in the compressed gas in the high-pressure gas chamber meets the specified vapor concentration limit requirements for its intended application.

Upon attaining P2, the high-pressure gas chamber is fluidly isolated from the liquid compression chamber, maintaining the gas's vapor content at the required level thereafter. The compressed gas is subsequently transferred from the high-pressure gas chamber to a storage tank, where it is stored at a storage pressure P3—typically substantially lower than P2—with the vapor content at or below the specified concentration limit for the intended application.

In another embodiment, the high-pressure gas chamber is maintained at a temperature lower than that of the liquid compression chamber, further reducing the vapor content of the compressed gas therein. This reduction in temperature in the high-pressure chamber enables a reduction in the required compression pressure P2.

In a further embodiment, inorganic additives are incorporated into the water used as the compression liquid, lowering the freezing point of the resulting compression liquid. This modification facilitates a decrease in the compression pressure P2.

These and additional features and advantages of the present invention will be apparent from the detailed description that follows, when considered in conjunction with the accompanying drawings and appended claims. It is to be understood that the invention is not limited to the specific operational details described herein or illustrated in the drawings, and may be embodied or practiced in various alternative forms not expressly disclosed, without departing from the scope of the invention.

DETAILED DESCRIPTION OF THE INVENTION

Figure 1:
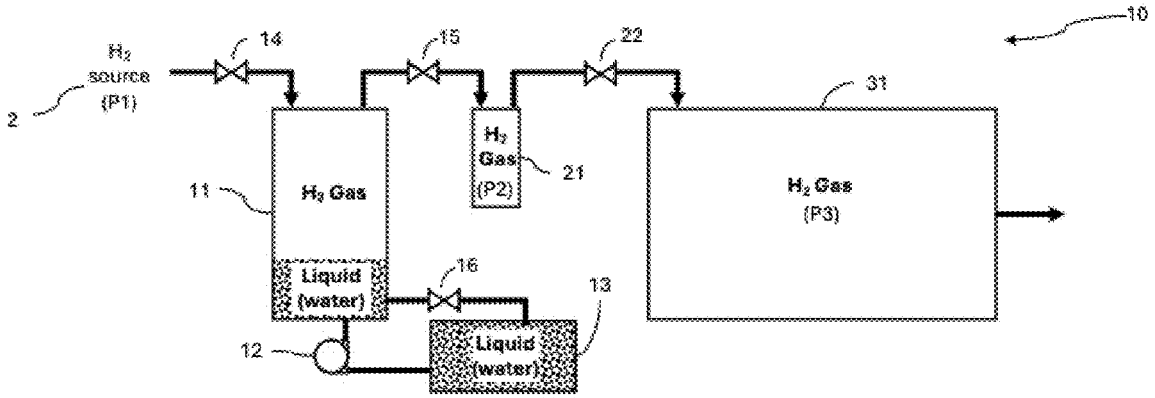
FIG. 1 is a schematic diagram of compressing hydrogen system in accordance with the present invention.

Referring to FIG. 1, a hydrogen compression system according to an embodiment of the present invention is illustrated and designated generally as 10. The system compresses gaseous hydrogen using a liquid, preferably water or a water-based liquid also known as aqueous solution, as the compression medium. The system comprises the following components: a liquid compression chamber 11, configured as in a liquid piston compressor; a high-pressure hydrogen gas chamber 21, fluidly connected to the output port of the liquid compression chamber 11 via a first feedline controlled by valve 15; a liquid pump 12, in fluid communication with the liquid compression chamber 11 via a second feedline; a liquid reservoir 13, connected to the liquid pump 12 via a third feedline and to the liquid compression chamber 11 via a fourth feedline controlled by valve 16, for storing and circulating the compression liquid; and a gaseous hydrogen storage tank 31, significantly larger in volume than the high-pressure gas chamber 21, fluidly connected thereto via a fifth feedline controlled by valve 22. Valves 14, 15, and 22, which regulate hydrogen gas flow during compression, are solenoid-operated (e.g., gate or check valves) and remotely adjustable between fully open and fully closed positions.

Gaseous hydrogen from a low-pressure source 2 enters the liquid compression chamber 11 through an inlet port controlled by valve 14. The inlet pressure, designated P1, corresponds to the pressure of the hydrogen source, typically ranging from 1 to 30 bars when derived from a production process such as electrolysis. In a multi-stage compression configuration, the source may be a prior compression stage, providing an inlet pressure at substantially higher level, for example, in the range of several hundred bars.

As hydrogen from source 2 enters the liquid compression chamber 11, the compression liquid within is displaced into the reservoir 13 through valve 16, propelled by the inlet pressure P1. Valve 16, a solenoid-operated gate valve, is remotely controlled between fully open and fully closed positions. The reservoir 13 maintains a pressure at or below P1. Under certain conditions, the liquid in chamber 11 is first drained to the reservoir 13 to reduce the chamber pressure before valve 14 opens to admit the source hydrogen.

Once the source hydrogen fills the liquid compression chamber 11 to a predetermined volume (e.g., 90%-95% of its capacity), valves 14 and 16 are closed. The liquid pump 12, such as a rotary pump driven by an electric motor, then delivers the compression liquid from the reservoir 13 into chamber 11. As the liquid fills chamber 11, the hydrogen pressure increases, and the hydrogen gas flows through valve 15 into the high-pressure gas chamber 21. The pressures within chambers 11 and 21 then equalize and increase concurrently as the liquid compression operation continues.

The volume ratio between chambers 11 and 21 is configured such that, when the liquid occupies approximately 90%-95% of chamber 11, the hydrogen in chamber 21 reaches a predetermined compression pressure, P2.

At the conclusion of the compression cycle, the pressure in chambers 11 and 21 stabilizes at or near P2. Valve 15 then closes, followed by the opening of valve 22, allowing the compressed hydrogen to flow from the high-pressure gas chamber 21 to the storage tank 31, driven by the pressure differential. The storage tank 31, designed with a substantially larger volume than chamber 21, stores the hydrogen up to a storage pressure P3, predetermined by its intended use and typically significantly lower than P2. As hydrogen transfers, the pressure in chamber 21 decreases while that in tank 31 increases, equilibrating at a level not exceeding P3. Once valve 15 is closed, the compressed hydrogen in chamber 21 and tank 31 is isolated from the compression liquid in chamber 11, thereby maintaining the vapor content at essentially the same level thereafter.

The described operation may be repeated multiple times, compressing hydrogen from the low-pressure source (P1) to the compression pressure (P2) within the system, then transferring it from chamber 21 to the storage tank 31 until the tank pressure reaches P3.

While FIG. 1 depicts hydrogen inlets and outlets entering chamber 11 at its top, such positioning is not essential. It is sufficient that these ports are located at the chamber's highest level to retain the compression liquid within chamber 11, preventing its entry into the high-pressure gas chamber 21 via the first feedline and valve 15, or backflow into the hydrogen source 2 via the inlet feedline and valve 14.

Alternative measures may prevent the compression liquid from entering the high-pressure gas chamber 21 or the hydrogen source 2. For instance, chamber 21 may be positioned above chamber 11 with an extended feedline, leveraging gravity to prevent the compression liquid reaching chamber 21. Alternatively, a liquid trap may be installed along the first feedline before valve 15 to capture any liquid before it reaches chamber 21. Another approach involves designing chamber 11 and controlling the compression process to minimize liquid splashing, maintaining a distinct interface between the hydrogen gas and the compression liquid. Similar configurations may prevent the compression liquid backflow into the source line 2 during hydrogen intake.

While the foregoing measures prevent the compression liquid ingress into the high-pressure gas chamber 21, they do not preclude the transfer of vaporized liquid or moisture mixed with the compressed hydrogen. Thus, chamber 21 contains primarily compressed hydrogen and vapor at or below its saturation limit in hydrogen, with no significant condensed liquid present during operation under this embodiment. Optionally, a liquid trapping device may be attached to chamber 21 to collect any condensate should condensation occur intermittently.

In accordance with the present invention, the predetermined compression pressure P2 is selected to ensure that the vapor concentration in the compressed hydrogen inside the high-pressure gas chamber 21 is below the purity limit required for its intended application, such as the limits specified in SAE J2719 and ISO 14687 for Proton Exchange Membrane (PEM) fuel cells. Across various applications, P2, determined by the vapor content in compressed hydrogen during liquid compression, substantially exceeds the storage pressure P3, which is established based on the requirements for storage or end use.

The relationship between the source pressure P1, the predetermined compression pressure P2, and the storage pressure P3 is exemplified as follows. Hydrogen produced via electrolysis—such as through an alkaline or PEM electrolyzer—typically exhibits a pressure of 1-30 bars (P1) and a water vapor content of approximately 8% by volume, or approximately 80000 μmol/mol. For transportation in a truck trailer to a hydrogen fueling station servicing hydrogen fuel cell electric vehicles, the hydrogen often is stored at 300 bars (P3) with a water vapor content not exceeding 5 μmol/mol. Under the present invention, achieving this vapor limit at a compression temperature of 5° C. requires a predetermined compression pressure P2 above approximately 1650 bars.

The determination of P2 in this invention leverages the established principle that the saturated vapor content in hydrogen is inversely proportional to pressure. Table 1 below presents selected minimum values of P2 required to reduce the water vapor content in hydrogen below specified limits when water is employed as the compression liquid, in accordance with the present invention.

TABLE 1

Minimum compression pressure (P2) in bars required to limit water vapor contents in hydrogen at different compression temperatures.

| Compression | Water content limit in hydrogen (μmol/mol) | | | |
|---|---|---|---|---|
| Temperature (° C.) | 50 | 20 | 10 | 5 |
| 20 | 460 | 1100 | 2200 | 4500 |
| 5 | 160 | 420 | 850 | 1650 |
| 1 | 130 | 320 | 650 | 1250 |

Alternatively, a vapor measurement and monitoring device can be installed to measure and monitor the vapor concentration inside the high-pressure gas chamber 21 during the liquid compression process. The compression pressure P2 is reached when the vapor concentration measured inside the gas chamber 21 is at or below a predefined concentration level.

As indicated in Table 1, the minimum compression pressure P2 required to achieve a specified water vapor content in hydrogen decreases with decreasing temperature. Accordingly, reducing the temperature of the liquid compression process lowers the necessary P2 for a given water vapor limit, offering operational advantages. This reduction can be facilitated by incorporating small quantities of additives into the compression liquid to depress its freezing point. For instance, sodium chloride (NaCl) or calcium chloride ($CaCl_2$)) may be added to water, significantly lowering its freezing point and enabling compression at reduced temperatures.

During operation of the compression system according to the present invention, water vapor in the hydrogen condenses as the gas is compressed. When a water-based liquid is employed as the compression medium, as preferred, this condensed vapor is absorbed by the compression liquid, mitigating any significant adverse impact by the water, either from condensation or from hydrogen source, on the compression process beyond a gradual increase in the volume of the compression liquid. The liquid reservoir readily accommodates this volume expansion. Additionally, any resultant changes in the chemical composition of the water-based liquid may be adjusted within the reservoir through the addition of appropriate additives.

Figure 2:
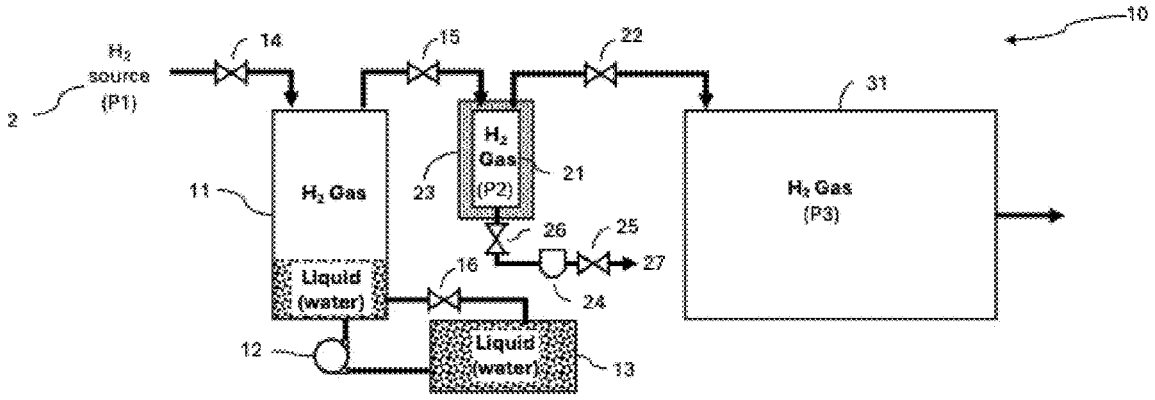
FIG. 2 is a schematic diagram of compressing hydrogen system of FIG. 1, having a thermally insulated high-pressure gas chamber.

In an embodiment illustrated in FIG. 2, the high-pressure gas chamber 21, containing compressed hydrogen, is housed within a thermally insulated container 23 equipped with a cooling medium to maintain chamber 21 at a temperature below the freezing point of the compression liquid in the liquid compression chamber 11. This configuration permits liquid compression in chamber 11 to occur above the liquid's freezing point while facilitating additional condensation of vapor in chamber 21 due to the reduction in temperature. The resulting condensate is removed from chamber 21 through valve 26, collected in a liquid trap 24, and subsequently drained externally via valve 25, further reducing the vapor content of the compressed hydrogen at the compression pressure P2.

In an alternative embodiment, the feedline connecting chamber 21 to the storage tank 31 is thermally insulated and cooled to a temperature below the freezing point of the compression liquid in chamber 11. This cooling extracts additional vapor from the compressed hydrogen via condensation prior to its entry into tank 31. Liquid collection and drainage lines, integrated into this feedline, remove the condensate, ensuring the hydrogen delivered to tank 31 meets vapor content requirements.

Figure 3:
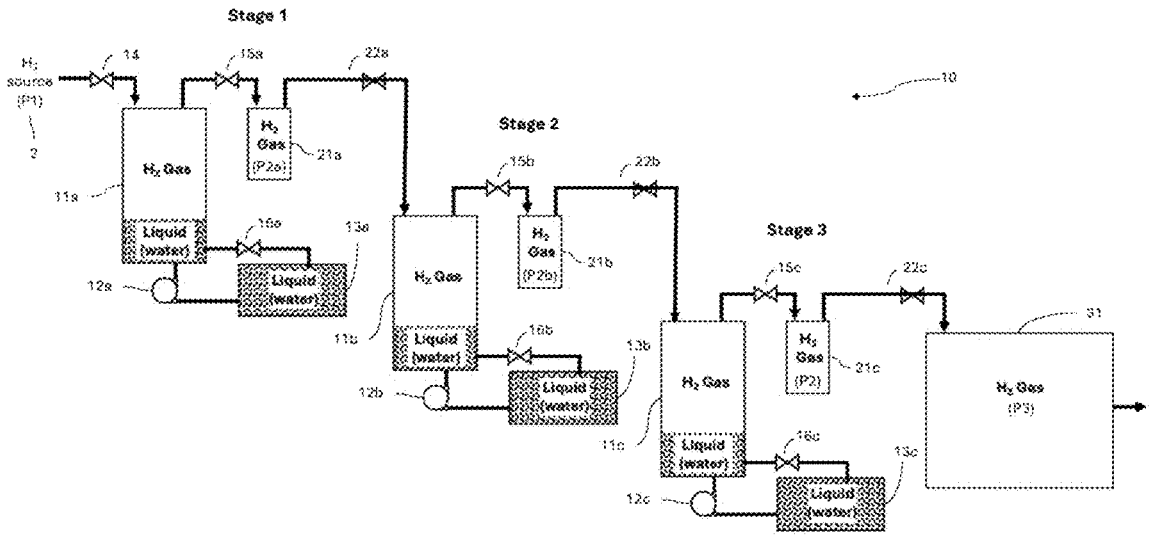
FIG. 3 is a schematic diagram of three-stage hydrogen compression system in accordance with the present invention.

In another embodiment, depicted in FIG. 3, hydrogen compression is executed in multiple stages, each comprising a liquid compression chamber (e.g., 11*a*, 11*b*, 11*c*) paired with a high-pressure gas chamber (e.g., 21*a*, 21*b*, 21*c*). The stages are serially connected, whereby hydrogen compressed to an intermediate pressure in one stage (e.g., from P1 to P2*a* in Stage 1) is fed into the subsequent stage for further compression (e.g., from P2*a* to P2*b* in Stage 2, and to P2 in Stage 3). This multi-stage approach optimizes compression ratios, particularly when the predetermined compression pressure P2, required for vapor control, is high and impractical to achieve in a single stage.

Figure 4:
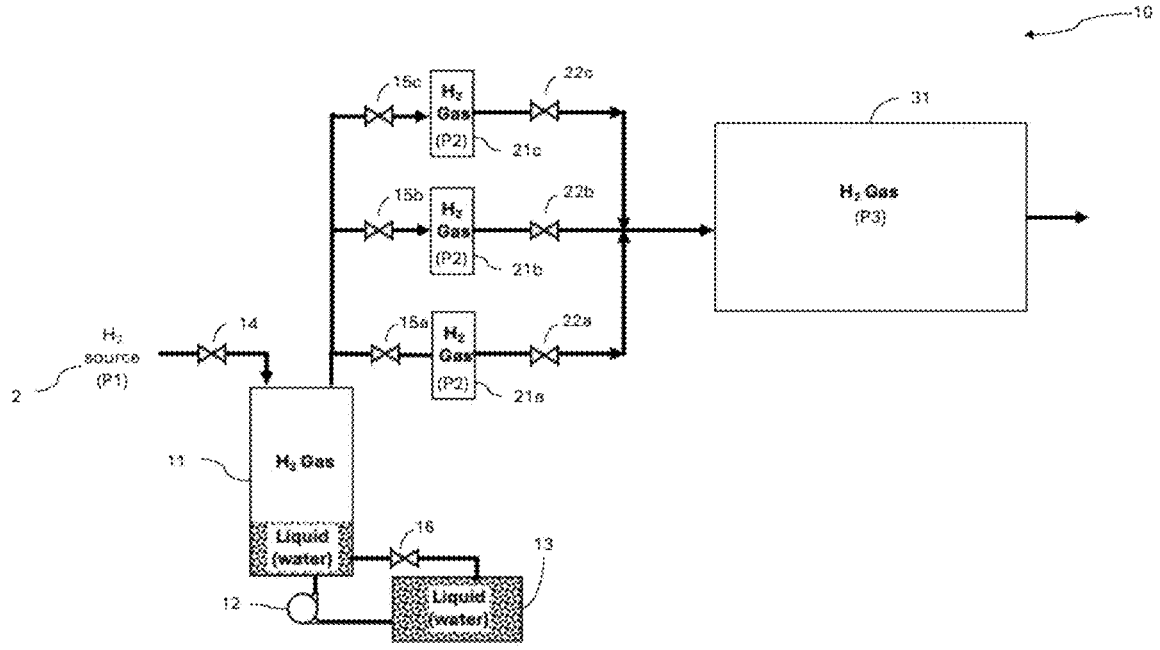
FIG. 4 is a schematic diagram of compressing hydrogen system of FIG. 1, having multiple high-pressure gas chambers.

In a further embodiment, shown in FIG. 4, a single liquid compression chamber 11 is fluidly connected to multiple high-pressure gas chambers (e.g., 21*a*, 21*b*, 21*c*), with valves regulating sequential connections to one chamber at a time. This configuration enhances throughput, proving advantageous when the transfer of compressed hydrogen from a high-pressure gas chamber to the storage tank 31 is slower than the compression process in chamber 11.

Figure 5:
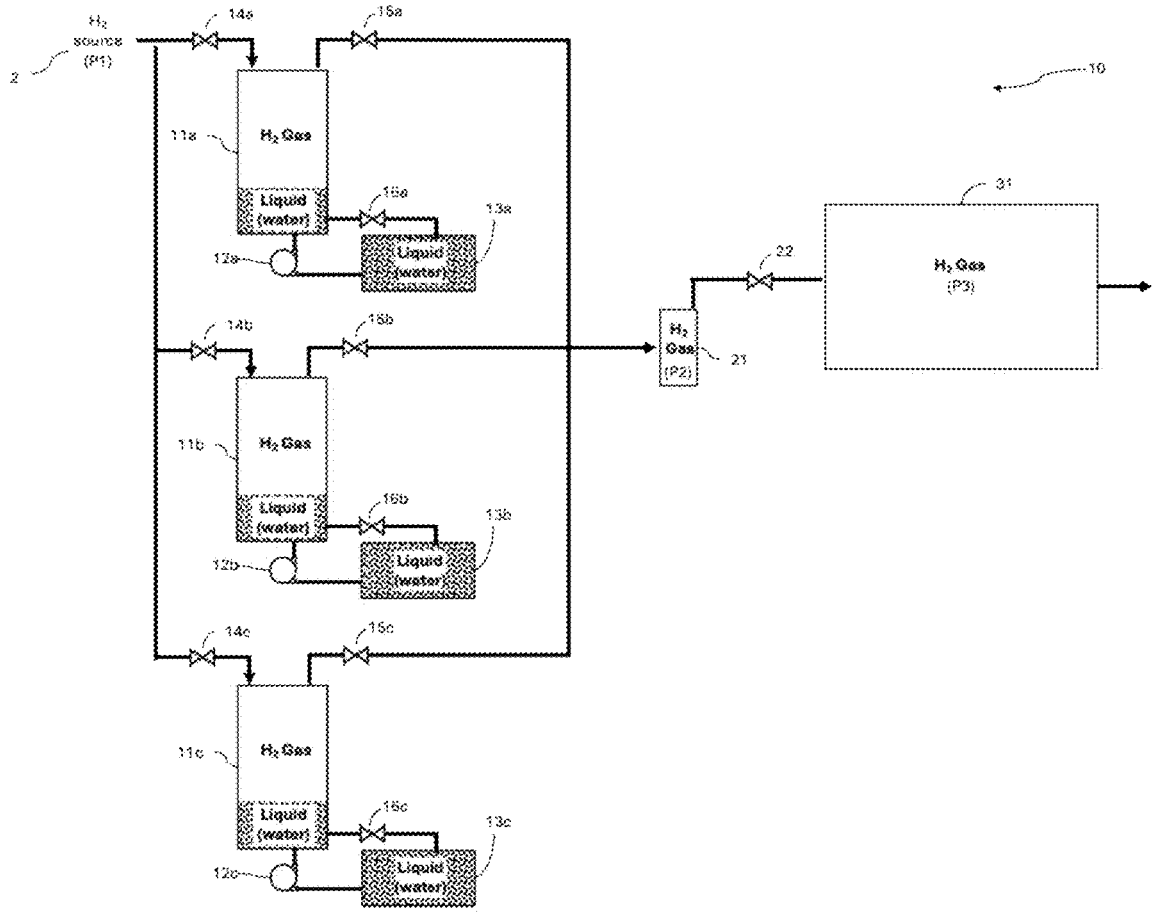
FIG. 5 is a schematic diagram of compressing hydrogen system of FIG. 1, having multiple liquid compression chambers.

In yet another embodiment, illustrated in FIG. 5, multiple liquid compression chambers (e.g., 11*a*, 11*b*, 11*c*) are connected to a single high-pressure gas chamber 21, with valves controlling sequential operation of one liquid compression chamber at a time. This arrangement increases throughput when the compression rate in the liquid compression chambers is slower than the transfer rate of hydrogen from chamber 21 to the storage tank 31. In this embodiment, each liquid compression chamber has its own liquid reservoir as shown in FIG. 5. Alternatively, all liquid compression chambers can share one liquid reservoir through separate feedlines, pumps and control valves.

In a further embodiment, the high-pressure gas chamber 21 includes a desiccant material (e.g., silica gel or molecular sieves) to adsorb residual water vapor from the compressed hydrogen. This desiccant, regenerable via heating or pressure cycling, provides a supplementary means to achieve vapor levels below the specified threshold, enhancing flexibility for applications with stringent purity requirements.

The embodiments described herein are broadly applicable to other gases beyond hydrogen, including nitrogen, helium, argon, air, and other indifferent gases that exhibits minimal chemical reactivity with the compression liquid under standard conditions. These gases all exhibit the general relationship wherein increased compression pressure reduces the saturation water vapor content in the compressed gas, with temperature exerting a similar influence on vapor content, as observed in hydrogen.

The foregoing description pertains to specific embodiments of the present invention. Various modifications and variations may be implemented without departing from the spirit and broader scope of the invention as defined by the appended claims, which are to be construed in accordance with established principles of patent law, including the doctrine of equivalents. This disclosure is provided for illustrative purposes and is not intended to exhaustively describe all possible embodiments or to restrict the scope of the claims to the precise elements illustrated or detailed herein. For instance, any individual element of the invention may be substituted with alternative elements that offer substantially equivalent functionality or otherwise ensure satisfactory performance. Such alternatives encompass currently known substitutes recognized by those skilled in the art, as well as future developments that a skilled artisan might, upon their emergence, identify as viable replacements. Moreover, the disclosed embodiments comprise multiple features that collectively contribute to a range of advantages; however, the invention is not limited to embodiments incorporating all such features or delivering all described benefits, unless explicitly stated otherwise in the issued claims. References to elements in the singular, using articles such as "a," "an," "the," or "said," shall not be interpreted as restricting those elements to a single instance.

REFERENCE NUMERALS

2 source of hydrogen
10 a hydrogen gas compression system in accordance with the present invention
11 liquid compression chamber
12 liquid pump
13 liquid reservoir
14 gas feedline and valve interconnecting hydrogen source 2 and liquid compression chamber 11
15 gas feedline and valve interconnecting liquid compression chamber 11 and high-pressure gas chamber 21
16 liquid feedline and valve interconnecting liquid compression chamber 11 and liquid reservoir 13
21 high-pressure hydrogen gas chamber
22 gas feedline and valve interconnecting high-pressure gas chamber 21 and storage tank 31
23 temperature control device to maintain the temperature in chamber 21
24 water collection and trapping device
25 feedline and valve to release water collected in device 24 to outside of the system.
26 feedline and valve interconnecting the chamber 21 and water collection device 24
31 hydrogen gas storage tank

What is claimed is:

1. A method for compressing an indifferent gas while controlling the concentration of vapor in the compressed gas, the method comprising:

a. providing a source of said gas;

b. delivering said gas from said source into a first chamber until said gas in said first chamber reaches a first predetermined pressure, wherein said first predetermined pressure is less than or equal to the pressure of the gas source;

c. introducing a compression liquid into said first chamber to compress said gas, thereby increasing its pressure;

d. permitting said gas, during compression, to flow from said first chamber to a second chamber through a first means of fluid interconnection that permits said gas to flow into but prevents said compression liquid from entering said second chamber, such that pressures in both chambers substantially equalize and rise concurrently until a second predetermined pressure is achieved in said second chamber, wherein said second pressure is selected such that the vapor concentration in said gas inside said second chamber is at or below a predefined concentration level;

e. closing said first means of fluid interconnection when the pressure in said second chamber reaches said second predetermined pressure level, thereby isolating said gas in said second chamber from said gas and said compression liquid in said first chamber;

f. transferring said isolated gas from said second chamber to a storage tank through a second means of fluid interconnection, wherein said gas in said storage tank is at or below a third predetermined pressure level that is less than said second predetermined pressure level, and wherein the vapor concentration in said gas inside said storage tank is at or below said predefined concentration level.

2. The method as claimed in claim 1, wherein said first means for fluidly interconnecting said first chamber and said second chamber remains closed during the transfer of said gas from said second chamber to said storage tank.

3. The method as claimed in claim 1, wherein said indifferent gas is from a group consisting of hydrogen, nitrogen, helium, argon, carbon dioxide, air, and mixtures thereof that exhibits minimal chemical reactivity with the compression liquid and the compression containment system under standard conditions.

* * * * *